US007899384B2

(12) United States Patent
Heid et al.

(10) Patent No.: US 7,899,384 B2
(45) Date of Patent: Mar. 1, 2011

(54) APPARATUS AND METHOD OF REDUCING CHARGE ROLLER CONTAMINATION

(75) Inventors: Matthew David Heid, Simpsonville, KY (US); James Christopher Piotrowski, Lexington, KY (US); Joshua Carl Poterjoy, Lexington, KY (US); Donald Wayne Stafford, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 134 days.

(21) Appl. No.: 12/265,501

(22) Filed: Nov. 5, 2008

(65) Prior Publication Data

US 2010/0111581 A1 May 6, 2010

(51) Int. Cl.
*G03G 21/00* (2006.01)

(52) U.S. Cl. ..... 399/350; 399/98; 399/99; 399/343

(58) Field of Classification Search ..... 399/98, 399/343, 99, 100, 101, 350
See application file for complete search history.

(56) References Cited

U.S. PATENT DOCUMENTS

| | | | | |
|---|---|---|---|---|
| 4,530,595 | A | 7/1985 | Itaya et al. | |
| 4,875,081 | A | 10/1989 | Goffe et al. | |
| 4,937,633 | A | 6/1990 | Ewing | |
| 4,947,216 | A | 8/1990 | Surti | |
| 5,229,817 | A | 7/1993 | Lange et al. | |
| 5,237,377 | A | 8/1993 | Harada et al. | |
| 5,298,953 | A | 3/1994 | Lindblad et al. | |
| 5,469,247 | A | 11/1995 | Cheng et al. | |
| 5,701,570 | A | 12/1997 | Takuma | |
| 5,701,571 | A | 12/1997 | Amamiya et al. | |
| 5,749,030 | A | 5/1998 | Park | |
| 5,819,138 | A * | 10/1998 | Hashizume | 399/98 |
| 5,999,773 | A | 12/1999 | Yasutomi et al. | |
| 6,021,304 | A | 2/2000 | Sbert et al. | |
| 6,122,460 | A | 9/2000 | Meece et al. | |
| 6,292,637 | B1 | 9/2001 | Lindblad et al. | |
| 6,522,851 | B2 | 2/2003 | Stickler | |
| 6,567,633 | B2 | 5/2003 | Burdick et al. | |
| 6,741,829 | B2 | 5/2004 | Stickler et al. | |
| 6,775,498 | B2 | 8/2004 | Palumbo | |
| 6,801,745 | B1 | 10/2004 | Gogate et al. | |
| 6,871,030 | B2 | 3/2005 | Nishimura | |
| 6,975,823 | B2 | 12/2005 | Onishi et al. | |
| 7,024,127 | B2 | 4/2006 | Hisakuni | |
| 7,231,163 | B2 | 6/2007 | Gopalanarayanan et al. | |
| 7,324,768 | B2 * | 1/2008 | Ravitz et al. | 399/49 |
| 2002/0025202 | A1 | 2/2002 | Itaya et al. | |
| 2002/0031385 | A1 | 3/2002 | Kato et al. | |
| 2003/0059227 | A1 | 3/2003 | Korfhage et al. | |
| 2003/0224274 | A1 | 12/2003 | Horikoshi et al. | |
| 2004/0213607 | A1 | 10/2004 | Ishii et al. | |
| 2006/0182475 | A1 * | 8/2006 | Gopalanarayanan et al. | 399/350 |
| 2008/0193178 | A1 * | 8/2008 | Sugimoto et al. | 399/354 |

* cited by examiner

*Primary Examiner*—Constantine Hannaher
(74) *Attorney, Agent, or Firm*—John Victor Pezdek

(57) ABSTRACT

An image forming equipment, e.g., a laser printer includes a photoconductive (PC) drum and an associated charge roller and incorporates a conductive polymer cleaner blade having an electrical potential to sufficiently charge contamination particles on the PC drum to electrically repel from a charged surface, such as the charge roller.

15 Claims, 2 Drawing Sheets

APPARATUS AND METHOD OF REDUCING CHARGE ROLLER CONTAMINATION

BACKGROUND

1. Field of Invention

The present invention relates generally to image forming equipment, e.g. a laser printer of the type which includes a photoconductive (PC) drum and a charge roller. The invention is disclosed in exemplary embodiment as a laser printer incorporating a cleaner blade with an electrical potential to sufficiently charge contamination particles on the PC drum to electrically repel from a charged surface, such as the charge roller.

2. Description of the Related Art

Image forming devices including copiers, laser printers, facsimile machines, and the like, include a photoconductive drum (hereinafter referred to as a drum), typically having a rigid cylindrical surface that is coated along a defined length of its outer surface. The surface of the drum is typically charged to a uniform electrical potential and then selectively exposed to light in a pattern corresponding to an original image. Those areas of the photoconductive surface exposed to light are discharged, thus forming a latent electrostatic image on the photoconductive surface.

A developer material, such as toner, having an electrical charge such that the toner is attracted to the photoconductive surface, is brought into contact with the drum's photoconductive surface. A recording sheet, such as a blank sheet of paper or a transfer belt, is then brought into contact with the photoconductive surface and the toner thereon is transferred to the recording sheet in the form of the latent electrostatic image. The recording sheet is then heated thereby permanently fusing the toner.

In preparation for the next image forming cycle, the photoconductive surface is optionally discharged and cleaned of residual toner. A cleaner blade may be positioned adjacent to the drum for mechanically removing any residual toner that has not been transferred during the printing process. Removal of the residual toner is desirable prior to preparing the drum to receive a new image.

In a laser printer, a photoconductive drum is typically used as the source object from which the image is initially formed by dots of laser light impacting the surface of this drum. The photoconductive drum is typically charged to a substantial voltage, such as a voltage greater than 1,000 VDC. This voltage could be either positive or negative with respect to ground, depending upon the charging system and the chemicals used in the photoconductive drum material. Additionally, an AC voltage superimposed on the DC voltage could be used.

For this photoconductive drum to achieve this substantially large voltage, it is typical for a charge roller to be placed into contact with the surface of the photoconductive drum. The charge roller typically comprises a moderately electrically conductive cylinder, or a semiconductive cylinder, which has an electrically conductive center that receives a high voltage from a high voltage power supply. As voltage is received at the electrically conductive center, this voltage charges the entire charge roller, including its outer cylindrical surface. This high voltage at the cylindrical surface of the charge roller is then passed onto the outer surface of the photoconductive drum as the drum rotates.

The ability of the charge roller to charge the photoconductive drum decreases over its life due to roller characteristics and contamination of the surface of the roller. This decrease in voltage may, over time, impact the ability of the photoconductive drum to produce accurate prints. Consequently, it is desirable to reduce buildup of contamination that occurs on the surface of the charge roller which may subsequently decrease charge roller life or reduce print quality.

SUMMARY OF THE INVENTION

In one exemplary summary embodiment, the present invention relates to a device for reducing the buildup of particulate contamination on elements within an image forming apparatus comprising a photoconductive element having a surface has a charged state at a first voltage level V1 and discharged state at a second voltage level V2, a charging element positioned against the photoconductive element for charging said photoconductive element to the charged state, and a conductive cleaner element for the photoconductive element having a portion positioned adjacent the surface of the photoconductive element, the cleaner element having a third voltage level V3 wherein $|V_1|>|V_2|>|V_3|$ and the particulate is charged by said portion of said cleaner element such that the particulate is repelled by said charging element.

In another exemplary summary embodiment, the present invention relates to a method for controlling the buildup of particulate contamination on elements of an image forming apparatus. The method includes providing a photoconductive element having a surface containing particulate contamination and an associated charging element. This is followed by providing a conductive cleaner element for the photoconductive element, the conductive element positioned adjacent the surface of the photoconductive element and charging the conductive cleaner element and in turn the particulate on the photoconductive element with an associated electrical potential. The particulate may assume an electrical potential such that it may be electrically repelled from the charging element.

BRIEF DESCRIPTION OF THE DRAWINGS

The accompanying drawings incorporated in and forming a part of the specification illustrate several aspects of the present invention, and together with the description and claims serve to explain the principles of the invention wherein:

FIG. 2 is a cross-sectional view of the details of the layout of the photoconductive drum and charge roller portions of the print engine of FIG. 1; and.

DETAILED DESCRIPTION OF THE PREFERRED EMBODIMENTS

The present invention includes an apparatus and method of controlling contamination build-up on the charge roll surface. Exemplary sources of contamination include the media to which the image is ultimately being transferred, which is generally a paper product, sub-micron $CaCO_3$, as well as residual toner which has not transferred from the photoconductive drum to the receiving media. Such contamination may act as a resistive layer that may reduce the charge delivered by the charge roll to the PC drum. The contaminants therefore may cause localized spots and/or extended regions of insufficient charge on the surface of the drum resulting in "dots" and/or "rings" of unwanted toner developed on the ensuing page of media. The spots are often called "background", and by measuring the amount of background a determination may be made as to the end of the useful life of a charge roller.

Figure 1:
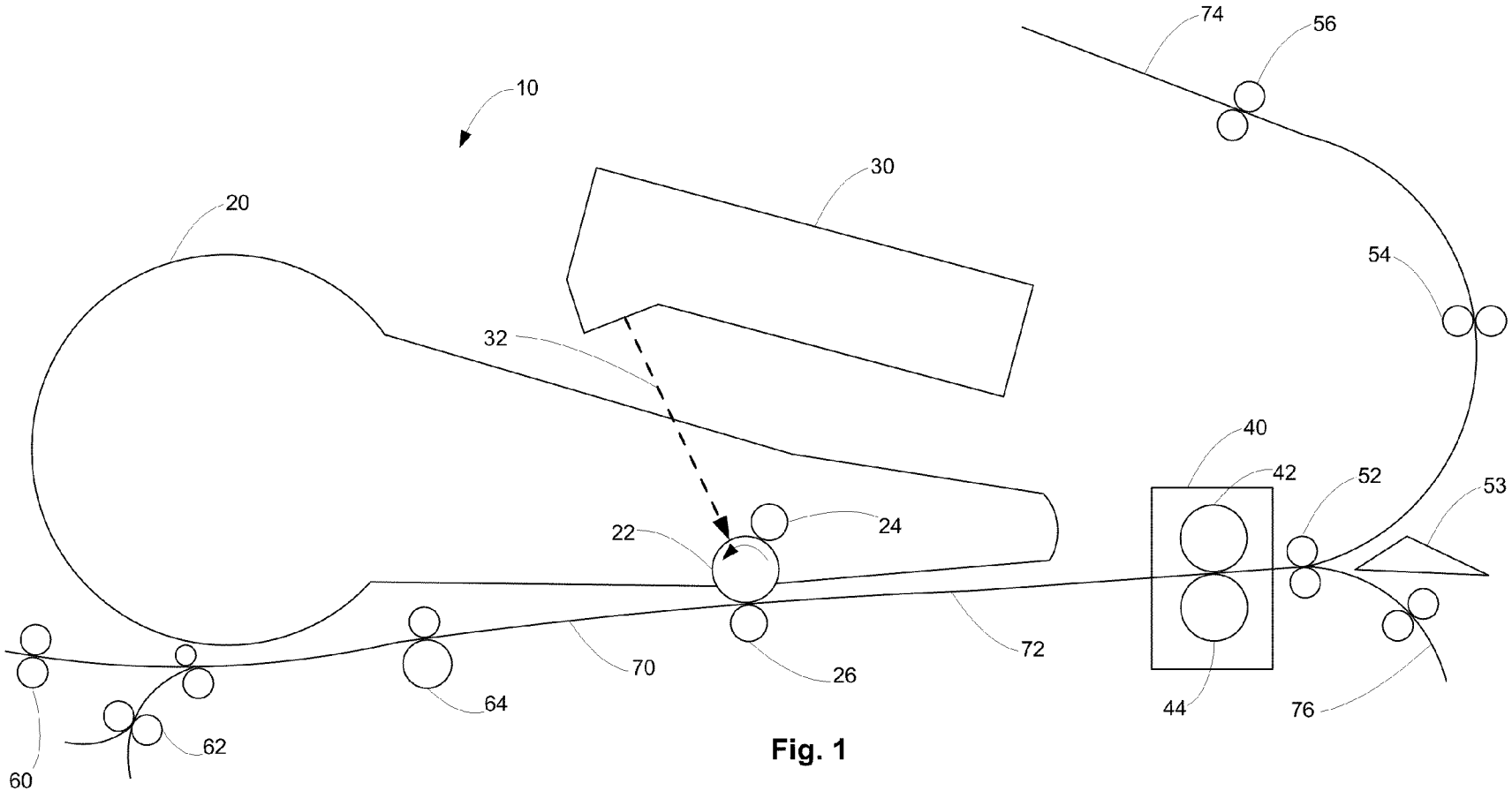
FIG. 1 is a diagrammatic view of some of the major components of an image forming device, visualizing its paper path through the print engine, and including the photoconductive drum and charge roller.

Referring now to the drawings, FIG. 1 shows the major components of a laser printer in diagrammatic view, in which the laser printer is generally designated by the reference numeral 10. A removable and replaceable electrophotographic (EP) process cartridge may be provided, generally designated by the reference numeral 20. This process cartridge 20 may include a new toner supply, photoconductive (PC) drum 22, developer roller 80, and a doctor blade 82 (see FIG. 2). The EP process cartridge may contain enough toner for up to, e.g., 25,000 prints, although smaller sized process cartridges may be employed that may only print up to 7,500 prints.

Laser printer 10 also may include a charge roller 24, a transfer roller 26, and a laser printhead 30. The charge roller 24 may have an operating life time of at least 250,000 prints, and perhaps as many as 300,000 prints. In a laser printer manufactured by Lexmark International Inc., the charge roller may be replaced as part of a maintenance kit, which also includes a new fuser 40, transfer roller 26, and certain paper path rollers. The laser printer may provide a message to the user when a "maintenance count" reaches 250,000 (representing 250,000 prints) by displaying a message on the operator panel for the user to see that it is time to have a maintenance kit installed.

Portions of the paper pathway for the laser printer 10 are also illustrated on FIG. 1, beginning at alternate pathways illustrated at the rollers 60 and 62, which allow paper to be supplied from more than one paper tray or from a manually-fed paper input. As the paper (or other type of print media) approaches the print engine, the pathways may merge at a final input roller set 64, and the paper pathway may continue at 70 until the paper reaches the photoconductive drum 22 at the print engine stage.

After the paper has had toner applied at the photoconductive drum and transfer roller nip, the paper may continue along a pathway 72 to a fuser 40, which may include a hot roller 42 and a backup roller 44. As the paper exits the fuser through rollers 52, the paper pathway may be diverted by gate 53 into several different directions, for example, along a pathway 76, or along a pathway 74 through rollers 54 and 56.

Figure 2:
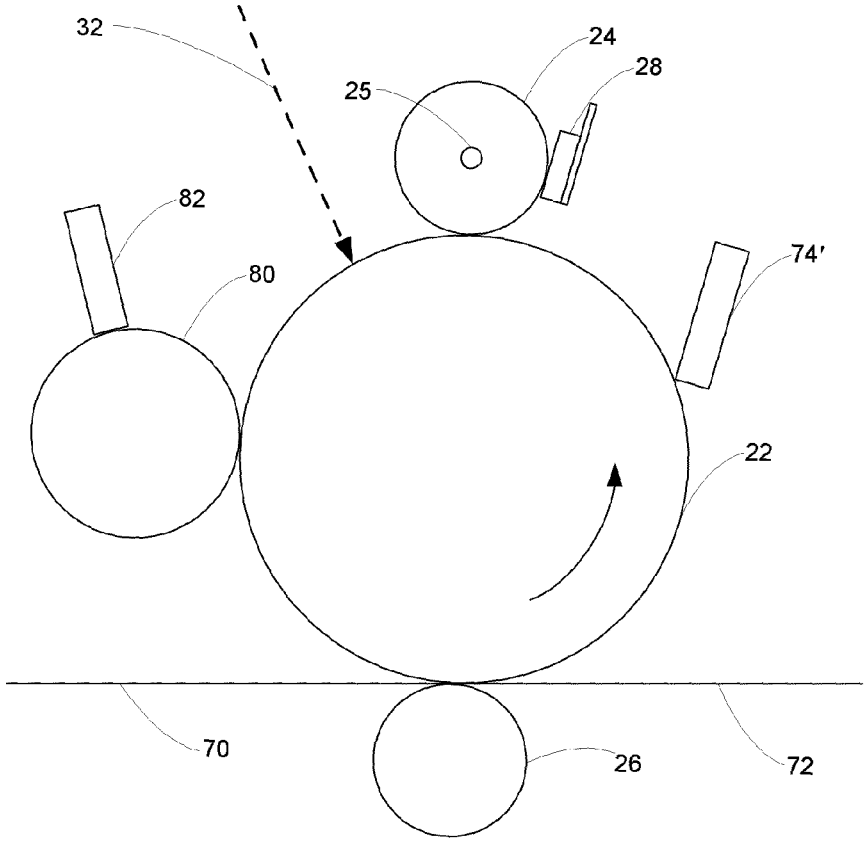

Referring now to FIG. 2, the details of the print engine portions that may affect the photoconductive drum are illustrated. The input paper pathway is depicted at 70, and the output paper pathway is depicted at 72. The laser light pathway is illustrated by dashed line 32, and this pathway of course may emanate from the laser printhead 30. (See FIG. 1). The laser light 32 discharges the surface of PC drum 22 to create a latent image of the information to be printed.

The charge roller 24 may contact with the cylindrical surface of the PC drum 22. A felt wiper, depicted at the reference numeral 28 may be supplied to assist the charge roller 24 to achieve the goal of becoming substantially free from contamination. In a laser printer, the felt wiper 28 may be replaced with every new EP process cartridge 20.

Toner material may be supplied using the developer roller 80, which may have an associated doctor blade 82 to maintain an even quantity of toner material across the width of the developer roller. As the toner material makes contact with the PC drum 22, the portions of that toner that are to be applied to the paper electrostatically attach themselves to the latent image on the surface of the PC drum 22 to form a toned image. As the toned image on the PC drum 22 reaches the paper, the toner is electrostatically attracted to the paper at the nip between the PC drum 22 and the transfer roller 26. A cleaner blade 74' may then be provided to mechanically clean off any excess residue of toner from the surface of the PC drum 22 or any other image bearing surface such as an image bearing surface on a photoreceptor belt.

The typical charge roller, as described in U.S. Pat. No. 5,637,391, may be made of HYDRIN rubber, which is manufactured by B.F. Goodrich Company. The outer cylindrical surface of the HYDRIN rubber may be preferably coated with a toner-type resin known as ACRYBASE 1406, which is manufactured by Fujikura Kasei Company, Limited of Tokyo, Japan. It is preferred that 10 micron particle size be used for this coating, and that the coating be baked onto the outer surfaces of the charge roller. The cylindrical HYDRIN portion of the charge roller may be mounted on a steel shaft 25, which may be electrically conductive and which may act as a high voltage electrode that is attached to an electrical wire that is run back to the output of a high voltage DC power supply.

As alluded to above, it has now been observed that there are various exemplary sources of the contamination which may collect on the surface of the PC drum 22 and which may then be attracted to the surface of the charge roller 24 and build up over many cycles of use. Accordingly, the contamination found on the surface of the PC drum 22 may comprise paper debris, submicron $CaCO_3$ particles, and toner. In such regard it is worth noting that $CaCO_3$ is increasingly used in the paper making process as a filler pigment, particularly to enhance the whiteness and brightness of paper.

It has also been found that $CaCO_3$ contamination has a non-zero electrical charge and that the charge level difference between the calcium carbonate particles and that of the surface of the PC drum 22 is great enough to generate sufficient attraction such that a conventional cleaner blade, having zero voltage, may not effectively separate the particles from the surface of the drum. Consequently, some particles may likely remain on the surface of the rotating drum 22 as it moves past an uncharged cleaner blade.

Figure 3:
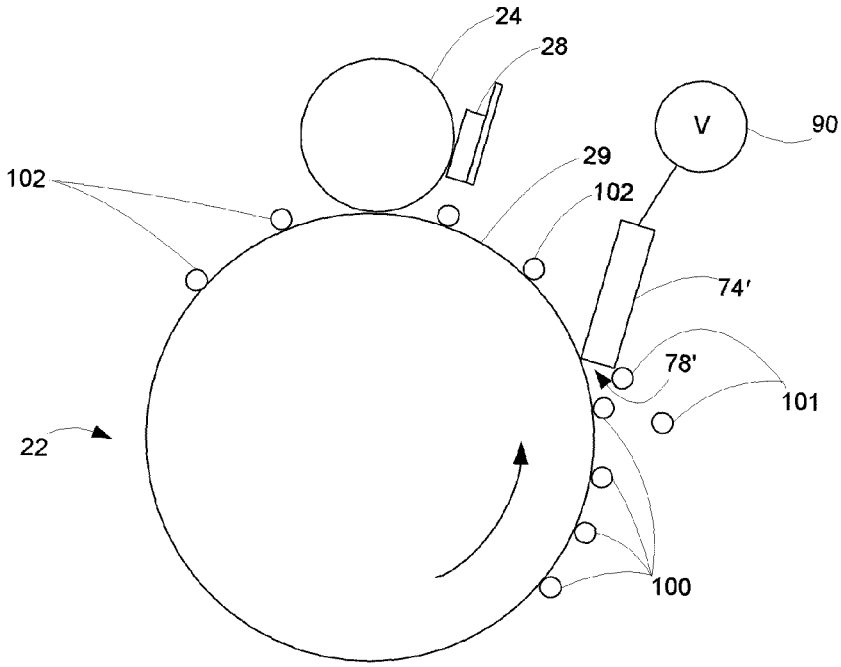
FIG. 3 is an enlarged view of a portion of FIG. 2 illustrating the present invention.

In accordance with the present invention, and in exemplary embodiment, and with reference to FIG. 3, an electrical potential V, 90 is provided to the conductive cleaner element such as blade 74'. The conductive cleaning element is attached to an electrical wire that is electrically connected to an output of a high voltage DC power supply. By providing the cleaner element with the electrical potential, the contamination particulate on the surface of the PC drum 22 (or any PC element having an image bearing surface) can be charged such that the particulate will not be substantially attracted to the charge roller 24 (or any charging element associated with a given PC element). Accordingly, substantial buildup of contamination particulate on the charge roller may now be conveniently reduced. It can also be appreciated that one important utility of such approach is that the use of a cleaner blade with an electrical potential, with the associated ability to alter or input a charge on the contamination particulate so that such particulate is electrically repelled from the charge roller, may serve to extend the life of the charge roller (measured in terms of the earlier referenced consideration of "background" development). Such extension in life of the charge roller may be one to several orders of magnitude over a charge roller that is associated with an uncharged cleaner blade. For example, the use of the cleaner blade herein, with the aforementioned electrical potential sufficient to alter or input a charge on the contamination particulate, may increase charge roll life up to three times that over those systems that rely upon a cleaner blade that does not provide an electrical potential to contamination particulate in accordance with the present invention.

Accordingly, the contamination particulate on the PC drum 22 herein may now be sufficiently charged via conductive cleaner blade 74' such that the particulate is not electrically attracted to a charged body, which is now understood to include the charge roller 24. With attention directed to FIG. 3, particles of contamination 100 are illustrated as remaining on the surface 29 of the PC drum 22 after transfer of the image to the media of choice. The cleaner blade 74' may of course scrape some of the contamination 101 from the surface 29 of the PC drum 22, however, some of the particulate contamination 102, particularly submicron particles of calcium carbonate may not be removed and may bypass the blade 74' and be attracted to the charge roller 24. As noted above, this may be due to the fact that the particulate contamination may have its own electrostatic attraction to the PC drum surface.

An electrical potential may be supplied to the conductive cleaner blade 74' which causes the remaining contamination 102 to become charged and remain substantially attached to the surface 29 of the drum 22. These now, charged particles of contamination 102, are then not attracted to other similarly (i.e., having the same polarity) charged bodies, such as the charge roller 24 as the drum rotates through the various steps in the image forming process. See again, FIG. 3, which illustrates the charged particles of contamination 102 as not being transferred to the charge roller 24. Accordingly, an additional mechanism, in addition to the charge roller wiper 28 (see FIG. 2) has been developed herein to provide a cleaner charge roller 24. In addition, it is worth noting that the charged particles of contamination 102, rather than being attracted to the charge roller 24, will continue to reside on the surface of the PC drum 22 and may conveniently end up being removed from the system and transferred to the media at the transfer roller nip in the next cycle.

It may be appreciated that particles of contamination may become lodged between the cleaner blade 74' and the PC drum 22. Such particles of contamination may result in rings of residual toner on the surface of charge roller 24 and streaks on a printed surface. Reversing a rotation of the PC drum 22 for a distance after transfer of the toned image to a media of choice, for example, may reduce lodging particles of contamination. In an embodiment, the PC drum 22 may be reversed a distance of about 1 millimeter.

The cleaner blade 74' of the present invention may preferably comprise a conductive polymeric material, preferably a polyurethane. The conductive polymeric material may be made electrically conductive via the addition of conductive agents such as ionic salts, polymer electrolytes, carbon black, and/or through the use of intrinsically electrically conductive polymers. Preferably, it has been found to employ a polyurethane type polymer in combination with lithium bis-trifluoromethanesulfonamide. In addition, ionic salts such as lithium perchlorate and cesium hexfluoroacetylacetonate may be employed. In an embodiment, the cleaner blade 74' may have a resistance of about $2.75\times10^8$ to about $4.25\times10^8$ ohms, including all ranges and values therebetween, with a preferred resistance of about $3.50\times10^8$ ohms. These exemplary and not limiting values may afford reduced contamination between the cleaner blade 74' and the PC drum 22.

The preferred cleaner blade may have a resiliency of about 5% to about 40%, including all ranges and values therebetween. Particularly preferred resiliency may be about 5% to about 15%. Preferably, the blade may have a Shore A hardness of about 72±10 units. Resiliency herein was determined according to ASTM D2632-01—Standard Test Method For Rubber Properties—Resilience By Vertical Rebound. These exemplary and non-limiting values may afford further improved wear resistance. It is also contemplated that other conductive polymers, beyond polyurethane, may be used in the context of the present invention. Accordingly, the conductive polymeric material for the conductive cleaner blade 74' may comprise other suitable thermoplastic elastomeric materials and/or thermoset elastomeric materials with the aforementioned characteristics.

The voltage supplied to charge the conductive cleaner blade 74' may preferably be such that the absolute value of the voltage at the tip 78' is less than the absolute value of the voltage at the surface of a discharged PC drum which is less than the absolute value of the voltage at the surface of a charged PC drum. More generally, the surface of the photoconductive element when charged may assume a first voltage level of $V_1$ and when the photoconductive element is discharged by the laser light the surface may have a second voltage level of $V_2$. The electrical potential provided by the conductive cleaner blade is such that it provides a voltage $V_3$ at the tip of the cleaning blade such that $|V_1|>|V_2|>|V_3|$. In other words, $V_1>V_2>V_3$ for $V_3\geqq0$ in a positively charged systems and $V_1\leqq V_2\leqq V_3$ for $V_3<0$ in a negatively charged system. In addition, reference to $|V_1|$ as used herein may be understood to mean the absolute value of $V_1$, likewise reference to $|V_2|$ and $|V_3|$ may be understood to mean absolute value of $V_2$ and $V_3$, respectively.

A voltage of about 1000 to about 2000 volts DC, preferably about 1600 volts, may be applied to the conductive cleaner blade 74'. However, due to internal losses, only a portion of that voltage may be provided to the PC drum 22 through the tip of the conductive cleaner blade 74', which value may be about 100 to about 450 volts, and preferably a value of about 275 volts. The electrical potential applied to the conductive polymer cleaning blade 74' preferably provides a voltage at the point of contact of the blade and the drum (and the particles of contamination) which is lesser in magnitude than the charge at the surface of an uncharged drum which is less than the magnitude of the voltage at the surface of the drum when it is charged. The voltage may be supplied by the printer from a dedicated source 90. For example, the voltage of the uncharged drum may be about 300 to about 700 volts and preferably about 325 volts. Similarly, the voltage of the charged drum may be about 950 to about 1250 volts, and preferably about 1100 volts. It may be appreciated that the potentials (voltages) described in the foregoing may be either positive or negative as long as the voltages $V_1$, $V_2$ and $V_3$ all have the same polarity. In other words for a positively charged system $V_1$ and $V_2$, may be greater than zero with $V_3$ being greater than or equal to zero and for a negatively charged system $V_1$ and $V_2$, may be less than zero with $V_3$ being less than or equal to zero.

It is worth noting that it was observed that in continuous printing, paper fibers may lodge in the nip generated between the contact of the conductive cleaner blade and the PC drum. Lodged paper fibers may then allow toner particles to pass under the cleaner blade and charge roller. This may result in "rings" of toner on the charge roll which may show up as a streaking defect in halftone printing.

In addition, a further benefit of the charged cleaner blade has been found. The charged cleaner blade electrostatically attracts paper dust that is commonly found in printers aiding in reducing contamination of the charge roller and PC drum.

The present disclosure may therefore prevent "ringing" of the charge roll. That is, raising the resistance of the cleaner blade herein to a nominal value of $3.5\times10^8$ ohms may now reduce the paper fiber lodging issue. Such a relatively resistant blade has shown to reduce or eliminate build-up of paper fibers at the cleaning nip as well as reducing or eliminating toner ringing of the charge roller. It may also be appreciated that in providing a reverse jog, a further reduction or elimination of paper fibers at the cleaning nip may be achieved.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

What is claimed is:

1. A device for reducing the buildup of particulate contamination on elements within an image forming apparatus, the device comprising:

a photoconductive element having a surface, wherein said surface of said photoconductive element has a charged state at a first voltage level $V_1$ and discharged state at a second voltage level $V_2$;

a charging element positioned against said photoconductive element for charging said photoconductive element to said charged state; and a conductive polymer cleaner blade for said photoconductive element, said cleaner blade having a resistance of about $2.75\times10^8$ to about $4.25\times10^8$ ohms, including all ranges and values therebetween, and an edge in contact with said surface of said photoconductive element with said edge of said cleaner blade having a continuously applied third voltage level $V_3$ wherein $|V_1|>|V_2|>|V_3|$ and said particulate is charged by said edge of said cleaner blade such that said particulate is repelled by said charging element.

2. The device of claim 1 wherein $|V_1|$ is about 1100 volts, $|V_2|$ is about 325 volts and $|V_3|$ is about 275 volts DC.

3. The device of claim 1, wherein said conductive polymer is a urethane.

4. The device of claim 1, wherein said conductive cleaner blade has a resistance of about $3.50\times10^8$ ohms.

5. The device of claim 1, wherein said voltage levels are one of a negative polarity and a positive polarity.

6. The device of claim 1, wherein said photoconductive element is a photoconductive drum and said charging element is a charge roller positioned against said photoconductive drum.

7. A method for reducing the buildup of particulate contamination elements in an image forming apparatus, said method comprising:

providing a photoconductive element having a surface containing particulate contamination and a charging element for said photoconductive element;

providing a conductive polymer cleaner blade for said photoconductive element, said conductive polymer cleaner blade having a resistance of about $2.75\times10^8$ to about $4.25\times10^8$ ohms, including all ranges and values therebetween, and an edge in contact with said surface of said photoconductive element;

charging said conductive polymer cleaner blade and providing said particulate contamination on said photoconductive element with an electrical potential, wherein the surface of said photoconductive element when charged has a first voltage level of $V_1$ and when said photoconductive element is discharged the surface has a second voltage level of $V_2$, and wherein said electrical potential provides a continuously applied voltage $V_3$ for the cleaner blade such that $|V_1|>|V_2|>|V_3|$; and periodically reversing a rotational direction of said photoconductive element a distance.

8. The method of claim 7 wherein said particulate contamination electrical potential is sufficient to repel from said charging element.

9. The method of claim 7, wherein $|V_1|$ is about 1100 volts, $|V_2|$ is about 325 volts and $|V_3|$ is about 275 volts DC.

10. The method of claim 7, wherein said conductive polymer is a urethane.

11. The method of claim 7, wherein said cleaner blade has a resistance of about $3.50\times10^8$ ohms.

12. The method of claim 7, wherein said particulate assumes a negative charge.

13. The method of claim 7, wherein said photoconductive element is a photoconductive drum.

14. The method of claim 7 wherein said particulate contamination comprises paper, $CaCO_3$ or toner.

15. The method of claim 7 wherein said distance is about 1 millimeter.

* * * * *